US011781268B2

(12) United States Patent
Shiraishi et al.

(10) Patent No.: US 11,781,268 B2
(45) Date of Patent: Oct. 10, 2023

(54) METHOD FOR PRODUCING PRINTED TEXTILE ITEM

(71) Applicant: RISO KAGAKU CORPORATION, Tokyo (JP)

(72) Inventors: Tetsuya Shiraishi, Ibaraki (JP); Akiko Hayashi, Ibaraki (JP); Kokoro Kinoe, Ibaraki (JP); Takahisa Yamazaki, Ibaraki (JP); Ryo Shinotsuka, Ibaraki (JP); Takumi Matsuda, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 2 days.

(21) Appl. No.: 17/828,319

(22) Filed: May 31, 2022

(65) Prior Publication Data

US 2022/0411999 A1 Dec. 29, 2022

(30) Foreign Application Priority Data

Jun. 29, 2021 (JP) ..... 2021-107619

(51) Int. Cl.

| | |
|---|---|
| ***D06P 5/00*** | (2006.01) |
| ***D06P 5/30*** | (2006.01) |
| ***B41M 5/00*** | (2006.01) |
| ***D06P 1/44*** | (2006.01) |
| ***D06P 1/00*** | (2006.01) |
| ***D06P 1/673*** | (2006.01) |

(52) U.S. Cl.

CPC ..... *D06P 5/30* (2013.01); *B41M 5/0023* (2013.01); *B41M 5/0047* (2013.01); *D06P 1/002* (2013.01); *D06P 1/445* (2013.01); *D06P 1/6735* (2013.01); *D06P 5/002* (2013.01)

(58) Field of Classification Search

CPC .. D06P 5/30; D06P 1/002; D06P 1/445; D06P 1/6735; D06P 5/002; D06P 1/44; D06P 1/5271; D06P 1/5285; D06P 1/673; D06P 1/67358; B41M 5/0023; B41M 5/0047; B41M 5/0017; B41M 5/0064

USPC ..... 8/499

See application file for complete search history.

(56) References Cited

U.S. PATENT DOCUMENTS

| | | | | |
|---|---|---|---|---|
| 8,328,340 | B2 | 12/2012 | Ogawa et al. | |
| 2017/0314194 | A1* | 11/2017 | Arai | D06P 1/5257 |
| 2018/0030301 | A1* | 2/2018 | Yamazaki | D06P 1/673 |
| 2020/0276849 | A1* | 9/2020 | Urano | D06P 1/67333 |
| 2020/0276850 | A1* | 9/2020 | Urano | B41J 2/2132 |
| 2021/0129568 | A1* | 5/2021 | Miyasa | B41J 2/04581 |

FOREIGN PATENT DOCUMENTS

| | | |
|---|---|---|
| JP | 2009-030014 A | 2/2009 |

* cited by examiner

*Primary Examiner* — Eisa B Elhilo
(74) *Attorney, Agent, or Firm* — GREENBLUM & BERNSTEIN, P.L.C.

(57) ABSTRACT

A method for producing a printed textile item is disclosed, the method including applying a pretreatment liquid containing a coagulant, water and a surfactant to a fabric, and, after the application of the pretreatment liquid, applying a white ink containing a white pigment and water to the fabric by an inkjet method, wherein a surface tension of the white ink at 0.05 Hz is within a range from 33 to 39 mN/m, a surface tension of the white ink at 10 Hz is 40 mN/m or greater, a specific gravity of the pretreatment liquid is greater than a specific gravity of the white ink, and the application of the white ink is performed within 100 seconds from the application of the pretreatment liquid and by a wet-on-wet method.

13 Claims, No Drawings

METHOD FOR PRODUCING PRINTED TEXTILE ITEM

CROSS REFERENCE TO RELATED APPLICATIONS

This application is based upon and claims the benefit of priority from the prior Japanese Patent Application No. 2021-107619, filed on Jun. 29, 2021, the entire contents of which are incorporated by reference herein.

BACKGROUND OF THE INVENTION

Field of the Invention

Embodiments of the present invention relate to a method for producing a printed textile item.

Description of the Related Art

Among methods for printing images such as text, pictures or designs onto fabrics or the like such as knitted fabrics, woven fabrics and nonwoven fabrics, in addition to screen textile printing methods and roller textile printing methods, textile inkjet printing methods are recently attracting attention.

In those cases where a pigment ink is used to print an image onto, for example, a dark colored fabric as a substrate, the image of the obtained printed textile item may sometimes be affected by the base color of the fabric, and the color development of the image may be inadequate. Methods for improving the substrate hiding performance have been investigated.

JP 2009-30014 A discloses a method including applying a pretreatment liquid containing a polyvalent metal salt to a fabric of a dark color such as black, and, thereafter, printing a white ink to form a white image, and forming a desired image thereon.

SUMMARY OF THE INVENTION

An embodiment of the present invention relates to a method for producing a printed textile item, the method including applying a pretreatment liquid containing a coagulant, water and a surfactant to a fabric, and, after the application of the pretreatment liquid, applying a white ink containing a white pigment and water to the fabric by an inkjet method, wherein a surface tension of the white ink at 0.05 Hz is within a range from 33 to 39 mN/m, a surface tension of the white ink at 10 Hz is 40 mN/m or greater, a specific gravity of the pretreatment liquid is greater than a specific gravity of the white ink, and the application of the white ink is performed within 100 seconds from the application of the pretreatment liquid and by a wet-on-wet method.

DETAILED DESCRIPTION OF THE EMBODIMENTS

Embodiments of the present invention are described below in detail, but the present invention is in no way limited by these embodiments, and various modifications and alterations may of course be performed.

The method for producing a printed textile item according to an embodiment of the present invention includes applying a pretreatment liquid containing a coagulant, water and a surfactant to a fabric, and, after the application of the treatment liquid, applying a white ink containing a white pigment and water to the fabric by an inkjet method, wherein the surface tension of the white ink at 0.05 Hz is within a range from 33 to 39 mN/m, the surface tension of the white ink at 10 Hz is 40 mN/m or greater, the specific gravity of the pretreatment liquid is greater than the specific gravity of the white ink, and the application of the white ink is performed within 100 seconds from the application of the pretreatment liquid and by a wet-on-wet method.

In those cases where a pretreatment liquid is applied, and, thereafter, without providing a drying step, a white ink is applied to form a white image by what is referred to as a wet-on-wet method, in which the white ink is applied in a state where the pretreatment liquid is not dried, it is preferable that the application amount of the pretreatment liquid is not too large, from the viewpoints of the anchoring effect caused by the permeation of the white ink into the fabric, and favorable fixability brought about by the anchoring effect. However, when the application amount of the pretreatment liquid is small, the white ink may easily permeate into the inside, and, thus, the substrate hiding performance may decline.

The pretreatment liquid may bleed or permeate into the inside of the fabric over time, and, therefore, the amount of the pretreatment liquid capable of reacting with the white ink per unit area tends to decrease over time. When the surface tension of the white ink at 0.05 Hz, which is a surface tension in a nearly static state, is within a range from 33 to 39 mN/m, and the time period from the application of the pretreatment liquid to the application of the white ink is 100 seconds or less, the white ink may react with a larger amount of the pretreatment liquid, and, therefore, the hiding performance may be improved.

When the surface tension of the white ink at 10 Hz is 40 mN/m or greater, permeation of the white ink into the fabric at the time of landing onto the fabric, at which time the ink is in a dynamic state, may be suppressed, and the hiding performance may be improved.

When the specific gravity of the pretreatment liquid is greater than the specific gravity of the white ink, for example, the permeation of the unreacted white ink into the fabric together with the pretreatment liquid may be suppressed, or the white ink is less likely to go below the pretreatment liquid. Therefore, the permeation of the white ink into the inside of the fabric may be suppressed, and the hiding performance may be improved.

In those cases where the white ink is applied within 100 seconds from the application of the pretreatment liquid, the time required for manufacturing may be shortened and the productivity may be improved.

The method for producing the printed textile item of one embodiment preferably includes applying a pretreatment liquid containing a coagulant, water and a surfactant to the fabric, and, after the application of the pretreatment liquid, applying a white ink containing a white pigment and water to the fabric by an inkjet method. The method for producing the printed textile item may further include applying a color ink by a wet-on-wet method after the application of the white ink. The fabric, the pretreatment liquid, the white ink and the color ink are described below.

<Fabric>

The method for producing a printed textile item according to one embodiment may be preferably used for printing to a fabric.

Examples of the fabric include fabrics containing natural fibers such as cotton, silk, wool, and linen; chemical fibers such as polyester, acrylic, polyurethane, nylon, rayon, cupra, and acetate; or a combination of two or more types of the above fibers. The fabric may be a woven fabric, a knitted fabric, a nonwoven fabric or the like.

<Pretreatment Liquid>

The pretreatment liquid preferably contains a coagulant.

As the coagulant, a component having an action that causes aggregation of the colorant of the ink on the fabric that is a substrate may be used. Consequently, as a result of further applying the white ink to the fabric to which the pretreatment liquid has been applied, the pigment of the white ink may be aggregated on the fabric, the image density of the white ink may be further increased, and the bleeding of the image may be prevented.

Specific examples of the coagulant include metal salts, cationic polymers and organic acids, and one of these may be used alone or a combination of two or more thereof may be used. As the metal salt, a polyvalent metal salt is preferred.

The coagulant is preferably a metal salt. From the viewpoint of the specific gravity of the pretreatment liquid, the coagulant is more preferably a polyvalent metal salt.

The total amount of the coagulant, expressed as the active ingredient amount relative to the total mass of the pretreatment liquid, is preferably 1% by mass or greater, more preferably 5% by mass or greater, further preferably 10% by mass or greater, and even further preferably 15% by mass or greater. The total amount of the coagulant, expressed as the active ingredient amount relative to the total mass of the pretreatment liquid, is preferably 40% by mass or less, more preferably 30% by mass or less, and further preferably 25% by mass or less. The total amount of the coagulant, expressed as the active ingredient amount relative to the total mass of the pretreatment liquid, is preferably within a range from 1 to 40% by mass, more preferably from 5 to 40% by mass, further preferably from 10 to 30% by mass, and even further preferably from 15 to 25% by mass.

The use of a polyvalent metal salt is preferred as the metal salt.

The polyvalent metal salt contains a polyvalent metal ion that is at least divalent, and an anion. Examples of the polyvalent metal ion that is at least divalent include $Ca^{2+}$, $Mg^{2+}$, $Cu^{2+}$, $Ni^{2+}$, $Zn^{2+}$, and $Ba^{2+}$. Examples of the anion include $Cl^-$, $NO_3^-$, $CH_3COO^-$, $I^-$, $Br^-$, and $ClO_3^-$. Specific examples of the polyvalent metal salt include calcium chloride, calcium nitrate, magnesium nitrate, copper nitrate, calcium acetate, and magnesium acetate. Among these, from the viewpoint of easily making the specific gravity of the pretreatment liquid greater than the specific gravity of the white ink, the pretreatment liquid preferably contains one or more selected from among calcium chloride, calcium nitrate and magnesium nitrate, and more preferably contains calcium nitrate. When such a polyvalent metal salt is used, the specific gravity of the pretreatment liquid may be easily made greater than the specific gravity of a white ink, even when the white ink contains a large amount of an inorganic pigment such as titanium oxide as the white pigment.

A single polyvalent metal salt may be used alone, or a combination of two or more polyvalent metal salts may be used.

From the viewpoint of the specific gravity of the pretreatment liquid, the amount of the polyvalent metal salt, expressed as the active ingredient amount relative to the total mass of the pretreatment liquid, is preferably 1% by mass or greater, more preferably 5% by mass or greater, further preferably 10% by mass or greater, and even further preferably 15% by mass or greater. The amount of the polyvalent metal salt, expressed as the active ingredient amount relative to the total mass of the pretreatment liquid, is preferably 40% by mass or less, more preferably 30% by mass or less, and further preferably 25% by mass or less. The amount of the polyvalent metal salt, expressed as the active ingredient amount relative to the total mass of the pretreatment liquid, is preferably within a range from 1 to 40% by mass, more preferably from 5 to 40% by mass, further preferably from 10 to 30% by mass, and even further preferably from 15 to 25% by mass.

When a metal salt hydrate is used as the polyvalent metal salt, the amount of the polyvalent metal salt (the active ingredient amount) is an amount expressed in terms of its anhydrate.

For the cationic polymer, a cationic water-soluble resin, a cationic water-dispersible resin, or a combination of these resins may be used.

Examples of cationic water-soluble resins include polyethylenimine (PEI), polyvinylamine, polyallylamine and salts thereof, polyvinylpyridine, and a cationic acrylamide copolymers. More specifically, for example, polydiallyldimethylammonium chloride and the like may be used.

Examples of commercially available products of cationic water-soluble resins include SHALLOL DC-303P, SHALLOL DC-902P and the like of the SHALLOL series, manufactured by DKS Co., Ltd., UNISENSE FCA1000L, UNISENSE FPA100L and the like of the UNISENSE series manufactured by Senka Corporation, and HC Polymer 1S, HC Polymer 1N, HC Polymer 1NS, HC Polymer 2, HC Polymer 2L and the like of the HC Polymer series manufactured by Osaka Organic Chemical Industry Co., Ltd. (all product names).

Examples of commercially available products of polyethyleneimines include EPOMIN SP-006, EPOMIN SP-012, EPOMIN SP-018, EPOMIN SP-200 and the like of the EPOMIN series manufactured by Nippon Shokubai Co., Ltd., and Lupasol FG, Lupsaol G20 Waterfree, and Lupasol PR 8515 manufactured by BASF Japan Ltd. (all product names).

Examples of commercially available products of polyallylamines include allylamine polymers PAA-01, PAA-03 and PAA-05, allylamine hydrochloride polymers PAA-HCL-01, PAA-HCL-03 and PAA-HCL-05, and the allylamine amide sulfate polymer PAA-SA manufactured by Nitto Boseki Co., Ltd. (all product names).

Examples of cationic water-dispersible resins include urethane resins, (meth)acrylic resins, styrene-(meth)acrylic resins, polyester resins, olefin resins, vinyl chloride resins, vinyl acetate resins, melamine resins, amide resins, ethylene-vinyl chloride copolymer resins, styrene-maleic anhydride copolymer resins, vinyl acetate-(meth)acrylic copolymer resins, vinyl acetate-ethylene copolymer resins, and composite resins of the above resins, into which cationic functional groups have been introduced, or which have undergone surface treatment with a cationic dispersant or the like to impart a positive surface charge to the resin. Representative examples of the cationic functional group include primary, secondary or tertiary amino groups, a pyridine group, an imidazole group, a benzimidazole group, a triazole group, a benzotriazole group, a pyrazole group and a benzopyrazole group. Examples of the cationic dispersant include primary, secondary, tertiary or quaternary amino group-containing acrylic polymers, polyethyleneimine, cationic polyvinyl alcohol resins, and cationic water-soluble multibranched polyesteramide resins. The term "(meth) acrylic resin" describes both acrylic resins and methacrylic resins.

Examples of commercially available products of cationic water-dispersible resins include SUPERFLEX 620 and SUPERFLEX 650 manufactured by DKS Co., Ltd., PP-15 and PP-17 manufactured by Meisei Chemical Works, Ltd., POLYSOL AP-1350 manufactured by Showa Denko K.K., VONCOAT SFC-55 manufactured by DIC Corporation, and AQUATEX AC-3100 manufactured by Japan Coating Resin Corporation (all product names).

A single cationic polymer may be used alone, or a combination of two or more cationic polymers may be used.

The amount of the cationic polymer, expressed as the active ingredient amount relative to the amount of the pretreatment liquid, is preferably within a range from 1 to 40% by mass, more preferably from 5 to 40% by mass, further preferably from 10 to 30% by mass, and even further preferably from 15 to 25% by mass.

Examples of the organic acid include formic acid, acetic acid, lactic acid, oxalic acid, citric acid, malic acid and ascorbic acid. In particular, an organic acid that is liquid at 23° C. may be preferably used. Preferable examples of the organic acid that is liquid at 23° C. include acetic acid and lactic acid.

A single organic acid may be used alone, or a combination of two or more organic acids may be used.

The amount of the organic acid, relative to the total mass of the pretreatment liquid, is preferably within a range from 1 to 40% by mass, more preferably from 5 to 40% by mass, further preferably from 10 to 30% by mass, and even further preferably from 15 to 25% by mass.

The pretreatment liquid preferably contains water.

There are no particular limitations on the water used, and examples of water include ion-exchanged water, distilled water, and ultrapure water.

The water in the pretreatment liquid may be the remainder of the other components including the coagulant.

For example, the amount of water, relative to the total mass of the pretreatment liquid, is preferably 20% by mass or greater, more preferably 30% by mass or greater, and further preferably 40% by mass or greater. The amount of water, relative to the total mass of the pretreatment liquid, may be, for example, 95% by mass or less, 90% by mass or less, or 80% by mass or less.

The amount of water, relative to the total mass of the pretreatment liquid, is, for example, preferably within a range from 20 to 95% by mass, more preferably from 30 to 90% by mass, and further preferably from 40 to 80% by mass.

The pretreatment liquid may contain a water-soluble organic solvent.

From the viewpoints of the treatment liquid viscosity adjustment and the moisture retention effects, the water-soluble organic solvent is preferably a water-soluble organic solvent that is liquid at room temperature and soluble in water.

The boiling point of the water-soluble organic solvent is preferably within a range from 180 to 300° C. From the viewpoint of suppressing the blockage of the head in the case of jetting the treatment liquid by an inkjet method, the boiling point of the water-soluble organic solvent is preferably 180° C. or higher. The boiling point of the water-soluble organic solvent is preferably 300° C. or lower from the viewpoint of suppressing the solvent bleeding of the image on the printed textile item.

Examples of water-soluble organic solvents include lower alcohols such as methanol, ethanol, 1-propanol, isopropanol, 1-butanol, 2-butanol, isobutanol, 1,3-propanediol, 1,3-butanediol, 1,2-butanediol, 1,2-pentanediol, 1,2-hexanediol and 2-methyl-2-propanol; glycols such as ethylene glycol, diethylene glycol, triethylene glycol, tetraethylene glycol, pentaethylene glycol, propylene glycol, dipropylene glycol and tripropylene glycol; glycerol; acetins such as monoacetin and diacetin; glycol derivatives such as diethylene glycol monomethyl ether, diethylene glycol monobutyl ether, diethylene glycol dimethyl ether, diethylene glycol monoethyl ether acetate, triethylene glycol monomethyl ether, triethylene glycol monoethyl ether, triethylene glycol monopropyl ether, triethylene glycol monobutyl ether, tripropylene glycol monobutyl ether, triethylene glycol monohexyl ether, tetraethylene glycol monomethyl ether, tetraethylene glycol monoethyl ether, tetraethylene glycol monobutyl ether, tetraethylene glycol dimethyl ether and tetraethylene glycol diethyl ether; as well as triethanolamine, pyrrolidone-based solvents such as 1-methyl-2-pyrrolidone, β-thiodiglycol and sulfolane.

Examples of the water-soluble organic solvents further include low-molecular weight polyalkylene glycols, including polyethylene glycols having an average molecular weight within a range from 190 to 630, such as an average molecular weight of 200, 300, 400 or 600, diol-type polypropylene glycols having an average molecular weight within a range from 200 to 600, such as an average molecular weight of 400, and triol-type polypropylene glycols having an average molecular weight within a range from 250 to 800, such as an average molecular weight of 300 or 700.

One of these water-soluble organic solvents may be used alone, or a combination of two or more of these solvents may be used. When two or more water-soluble organic solvents are used, these water-soluble organic solvents, together with water, preferably form a single phase.

The amount of the water-soluble organic solvent, relative to the total mass of the pretreatment liquid, is preferably 1% by mass or greater, more preferably 5% by mass or greater, and further preferably 10% by mass or greater. The amount of the water-soluble organic solvent, relative to the total mass of the pretreatment liquid, is preferably 50% by mass or less, more preferably 40% by mass or less, and further preferably 30% by mass or less. The amount of the water-soluble organic solvent, relative to the total mass of the pretreatment liquid, is preferably within a range from 1 to 50% by mass, more preferably from 5 to 40% by mass, and further preferably from 10 to 30% by mass.

The pretreatment liquid may further contain one or more other components, examples thereof including surfactants, antifoaming agents, pH adjusters, antioxidants and preservatives, if necessary.

Any surfactant selected from among anionic surfactants, cationic surfactants, amphoteric surfactants, and nonionic surfactants may be used as the surfactant. From the viewpoint of preventing foaming of the pretreatment liquid, the use of a nonionic surfactant is preferred. The surfactant may be a low-molecular weight surfactant or a high-molecular weight surfactant.

The HLB value of the surfactant is preferably within a range from 5 to 20, more preferably from 10 to 18.

Examples of nonionic surfactants include ester-based surfactants such as glycerol fatty acid esters and sorbitan fatty acid esters; ether-based surfactants such as polyoxyethylene alkyl ethers, polyoxyethylene alkyl phenyl ethers and polyoxypropylene alkyl ethers; ether-ester-based surfactants such as polyoxyethylene sorbitan fatty acid esters; acetylene-based surfactants; silicone-based surfactants; and fluorine-based surfactants. Among these, preferable examples of nonionic surfactants include acetylene-based surfactants and silicone-based surfactants.

Examples of the acetylene-based surfactant include acetylene glycol-based surfactants, acetylene alcohol-based surfactants, and surfactants having an acetylene group.

The acetylene glycol-based surfactant is a glycol having an acetylene group, and is preferably a glycol having a symmetrical structure in which the acetylene group is positioned at the center. The acetylene glycol-based surfactant may have a structure in which ethylene oxide is added to acetylene glycol.

Examples of commercially available products of the acetylene-based surfactants include Surfynol 104E, Surfynol 104H, Surfynol 420, Surfynol 440, Surfynol 465, Surfynol 485 and the like of the Surfynol series manufactured by Evonik Industries, and OLFINE E1004, OLFINE E1010, OLFINE E1020 and the like of the OLFINE series manufactured by Nissin Chemical Industry Co., Ltd. (all product names).

Examples of the silicone-based surfactants include polyether-modified silicone-based surfactants, alkyl/aralkyl co-modified silicone-based surfactants, and acrylic silicone-based surfactants.

Examples of commercially available products of the silicone-based surfactants include SILFACE SAG002 and SILFACE 503A manufactured by Nissin Chemical Industry Co., Ltd. (both product names).

Examples of nonionic surfactants further include polyoxyethylene alkyl ether-based surfactants, such as EMULGEN 102KG, EMULGEN 103, EMULGEN 104P, EMULGEN 105, EMULGEN 106, EMULGEN 108, EMULGEN 120, EMULGEN 147, EMULGEN 150, EMULGEN 220, EMULGEN 350, EMULGEN 404, EMULGEN 420, EMULGEN 705, EMULGEN 707, EMULGEN 709, EMULGEN 1108, EMULGEN 4085, EMULGEN 2025G and the like of the EMULGEN series manufactured by Kao Corporation (all product names).

Examples of anionic surfactants include EMAL 0, EMAL 10, EMAL 2F, EMAL 40, EMAL 20C and the like of the EMAL series, NEOPELEX GS, NEOPELEX G-15, NEOPELEX G-25, NEOPELEX G-65 and the like of the NEOPELEX series, PELEX OT-P, PELEX TR, PELEX CS, PELEX TA, PELEX SS-L, PELEX SS-H and the like of the PELEX series, and DEMOL N, DEMOL NL, DEMOL RN, DEMOL MS and the like of the DEMOL series, all manufactured by Kao Corporation (all product names).

Examples of cationic surfactants include ACETAMIN 24, ACETAMIN 86 and the like of the ACETAMIN series, QUARTAMIN 24P, QUARTAMIN 86P, QUARTAMIN 60W, QUARTAMIN 86W and the like of the QUARTAMIN series, and SANISOL C, SANISOL B-50 and the like of the SANISOL series, all manufactured by Kao Corporation (all product names).

Examples of amphoteric surfactants include AMPHITOL 20BS, AMPHITOL 24B, AMPHITOL 86B, AMPHITOL 20YB, AMPHITOL 20N and the like of the AMPHITOL series manufactured by Kao Corporation (all product names).

With respect to the above-described surfactant, a single surfactant is preferably used, but two or more surfactants may be used in combination.

The amount of the surfactant may depend on the type of the surfactant, but from the viewpoints of the surface tension of the pretreatment liquid, the permeation of the pretreatment liquid to the fabric, and the like, the amount of the surfactant, expressed as the active ingredient amount relative to the total mass of the pretreatment liquid, is preferably within a range from 0.1 to 10% by mass, more preferably from 0.2 to 5% by mass, and further preferably from 0.4 to 2% by mass. The amount of the surfactant, expressed as the active ingredient amount relative to the total mass of the pretreatment liquid, is preferably 0.1% by mass or greater, more preferably 0.2% by mass or greater, and further preferably 0.4% by mass or greater. The amount of the surfactant, expressed as the active ingredient amount relative to the total mass of the pretreatment liquid, is preferably 10% by mass or less, more preferably 5% by mass or less, and further preferably 2% by mass or less.

There are no particular limitations on the method used for producing the pretreatment liquid, and production may be performed using an appropriate conventional method. For example, the pretreatment liquid may be prepared by placing all of the components in a stirring device such as a three-one motor and dispersing the components, either in a single batch or in a number of separate batches, and then, if required, passing the resulting dispersion through a filtration device such as a membrane filter.

From the viewpoint of improving the hiding performance, the specific gravity of the pretreatment liquid is preferably greater than the specific gravity of the white ink.

The specific gravity of the pretreatment liquid is preferably at least 0.001 greater than the specific gravity of the white ink, more preferably at least 0.005 greater than the specific gravity of the white ink, further preferably at least 0.010 greater than the specific gravity of the white ink, even further preferably at least 0.020 greater than the specific gravity of the white ink, even further preferably at least 0.030 greater than the specific gravity of the white ink, and even further preferably at least 0.040 greater than the specific gravity of the white ink. The difference between the specific gravity of the pretreatment liquid and the specific gravity of the white ink may be, for example, 0.070 or less, 0.060 or less, or 0.050 or less. The difference between the specific gravity of the pretreatment liquid and the specific gravity of the white ink may be, for example, within a range from 0.001 to 0.070, from 0.005 to 0.070, from 0.010 to 0.070, from 0.020 to 0.070, from 0.030 to 0.060, or from 0.040 to 0.050.

The specific gravity of the pretreatment liquid is a value determined at 23° C., and can be determined using, for example, a density/specific gravity meter. For the measurement of the specific gravity, for example, a portable density/specific gravity meter DA-130N manufactured by Kyoto Electronics Manufacturing Co., Ltd. can be used.

The specific gravity of the pretreatment liquid is preferably 1.050 or greater, more preferably 1.100 or greater, and further preferably 1.110 or greater. The specific gravity of the pretreatment liquid is preferably 1.300 or less, and more preferably 1.200 or less. The specific gravity of the pretreatment liquid is preferably within a range from 1.050 to 1.300, more preferably from 1.100 to 1.200, and further preferably from 1.110 to 1.200.

The specific gravity of the pretreatment liquid can be controlled by, for example, the type and amount of components of the pretreatment liquid such as a coagulant.

<White Ink>

The white ink may contain a white pigment as a colorant.

Examples of white pigments include inorganic pigments such as titanium oxide, zinc oxide, zinc sulfide, antimony oxide and zirconium oxide. Examples of white pigments further include hollow resin microparticles and polymer microparticles. Of these pigments, from the viewpoint of the hiding performance, the use of titanium oxide is preferred. The average particle size of the titanium oxide is preferably 50 nm or greater from the viewpoint of the hiding performance. The average particle size of the titanium oxide is preferably 500 nm or less from the viewpoint of jetting stability. In those cases where titanium oxide is used, titanium oxide that has undergone a surface treatment with alumina or silica is preferably used in order to inhibit any photocatalytic action. The amount of this surface treatment preferably represents about 5 to 20% by mass of the pigment.

A self-dispersing pigment described below may be used as the pigment.

A pigment dispersion in which a pigment has been dispersed in advance using a pigment dispersant may be used. A pigment dispersion dispersed using a pigment dispersant described below may be used.

A single white pigment may be used alone or a combination of two or more white pigments may be used.

From the viewpoint of, for example, the hiding performance, the amount of the white pigment, expressed as the active ingredient amount (pigment concentration) relative to the total mass of the white ink, is preferably 1% by mass or greater, more preferably 3% by mass or greater, and further preferably 5% by mass or greater. From the viewpoint of jetting properties, the amount of the white pigment, expressed as the active ingredient amount (pigment concentration) relative to the total mass of the white ink, is preferably 30% by mass or less, more preferably 20% by mass or less, and further preferably 15% by mass or less. The amount of the white pigment, expressed as the active ingredient amount (pigment concentration) relative to the total mass of the white ink, is preferably within a range from 1 to 30% by mass, more preferably from 3 to 20% by mass, and further preferably from 5 to 15% by mass.

A pigment dispersant typified by polymeric dispersants and surfactant-type dispersants is preferably used to ensure stable dispersion of the pigment in the ink.

Examples of commercially available polymeric dispersants include TEGO Dispers 740W, TEGO Dispers 750W, TEGO Dispers 755W, TEGO Dispers 757W, TEGO Dispers 760W and the like of the TEGO Dispers series manufactured by Evonik Industries, Solsperse 20000, Solsperse 27000, Solsperse 41000, Solsperse 41090, Solsperse 43000, Solsperse 44000, Solsperse 46000 and the like of the Solsperse series manufactured by The Lubrizol Corporation, Joncryl 57, Joncryl 60, Joncryl 62, Joncryl 63, Joncryl 71, Joncryl 501 and the like of the Joncryl series manufactured by BASF Japan, Ltd., as well as DISPERBYK-102, DISPERBYK-185, DISPERBYK-190, DISPERBYK-193 and DISPERBYK-199 manufactured by BYK Chemie Japan K.K., and Polyvinylpyrrolidone K-30 and Polyvinylpyrrolidone K-90 manufactured by DKS Co. Ltd. (all product names).

Examples of the surfactant-type dispersants include anionic surfactants such as DEMOL P, DEMOL EP, DEMOL N, DEMOL RN, DEMOL NL, DEMOL RNL, DEMOL T-45 and the like of the DEMOL series manufactured by Kao Corporation, and nonionic surfactants such as EMULGEN A-60, EMULGEN A-90, EMULGEN A-500, EMULGEN B-40, EMULGEN L-40, EMULGEN 420 and the like of the EMULGEN series manufactured by Kao Corporation (all product names).

One of these pigment dispersants may be used alone, or a combination of two or more pigment dispersants may be used.

There are no particular limitations on the amount of the pigment dispersant in the ink, which may vary depending on the type of dispersant used, but generally, the mass ratio of the pigment dispersant (active ingredient) relative to a value of 1 for the pigment (pigment concentration) is preferably within a range from 0.005 to 0.5.

The white ink preferably contains water as an aqueous solvent, and the main solvent may be water.

There are no particular limitations on this water, but water containing minimal ionic components is preferred. From the viewpoint of the ink storage stability, the amount of polyvalent metal ions such as calcium ions is preferably kept low. Examples of the water include ion-exchanged water, distilled water and ultra-pure water.

From the viewpoint of the ink viscosity adjustment, the amount of water, relative to the total mass of the white ink, is preferably within a range from 10 to 80% by mass, more preferably from 20 to 70% by mass, and further preferably from 30 to 60% by mass. The amount of water, relative to the total mass of the white ink, is preferably 10% by mass or greater, more preferably 20% by mass or greater, and further preferably 30% by mass or greater. The amount of water, relative to the total mass of the white ink, is preferably 80% by mass or less, more preferably 70% by mass or less, and further preferably 60% by mass or less.

The white ink may contain a water-soluble organic solvent together with water.

From the viewpoints of the ink viscosity adjustment and the moisture retention effects, the water-soluble organic solvent is preferably a water-soluble organic solvent that is liquid at room temperature and soluble in water.

The boiling point of the water-soluble organic solvent is preferably within a range from 180 to 300° C. From the viewpoint of suppressing the blockage of the head in the case of jetting the white ink by an inkjet method, the boiling point of the water-soluble organic solvent is preferably 180° C. or higher. The boiling point of the water-soluble organic solvent is preferably 300° C. or lower from the viewpoint of suppressing the solvent bleeding of the image on the printed textile item.

As the water-soluble organic solvent, for example, one water-soluble organic solvent or a combination of two or more water-soluble organic solvents, selected from among the water-soluble organic solvents that may be used in the pretreatment liquid as described above, may be used.

When two or more water-soluble organic solvents are used, these water-soluble organic solvents, together with water, preferably form a single phase.

From the viewpoints of the ink viscosity adjustment, the moisture retention effects and the surface tension adjustment, the amount of the water-soluble organic solvent, relative to the total mass of the white ink, is, for example, preferably within a range from 1 to 50% by mass, more preferably from 5 to 40% by mass, and further preferably from 10 to 30% by mass. From the viewpoint of the moisture retention effects, the amount of the water-soluble organic solvent, relative to the total mass of the white ink, is preferably 1% by mass or greater, more preferably 5% by mass or greater, and further preferably 10% by mass or greater. From the viewpoint of the viscosity adjustment, the amount of the water-soluble organic solvent, relative to the total mass of the white ink, is preferably 50% by mass or less, more preferably 40% by mass or less, and further preferably 30% by mass or less.

The white ink preferably contains a surfactant.

When the surfactant is incorporated in the white ink as a surface tension adjuster, the ink may be jetted more stably by an inkjet method, and the permeability of the ink to the fabric may be more adequately controlled. From the viewpoint of efficiently adjusting the surface tension of the white ink at 0.05 Hz and the surface tension of the white ink at 10 Hz, the white ink preferably contains a surfactant.

Any surfactant selected from among anionic surfactants, cationic surfactants, amphoteric surfactants, and nonionic surfactants may be used as the surfactant. From the viewpoint of preventing foaming of the ink, the use of a nonionic surfactant is preferred. The surfactant may be a low-molecular weight surfactant or a high-molecular weight surfactant.

The HLB value of the surfactant is preferably within a range from 5 to 20, more preferably from 10 to 18.

As the surfactant, for example, one surfactant or a combination of two or more surfactants, selected from among the surfactants that may be used in the pretreatment liquid as described above, may be used. From the viewpoint of efficiently adjusting the surface tension of the white ink at 0.05 Hz and the surface tension of the ink at 10 Hz, the surfactant is preferably an acetylene-based surfactant such as an acetylene glycol-based surfactant, and more preferably an acetylene glycol-based surfactant.

The amount of the surfactant (in those cases where the ink further contains a surfactant as a pigment dispersant, the total amount including the amount of the surfactant as a pigment dispersant) may vary depending on the type of dispersant, but from the viewpoints of the surface tension of the white ink and the permeability of the white ink to the fabric, the amount of the surfactant, expressed as the active ingredient amount relative to the total mass of the white ink, is preferably within a range from 0.1 to 10% by mass, more preferably from 0.2 to 5% by mass, further preferably from 0.2 to 4% by mass, and even further preferably from 0.4 to 1% by mass. The amount of the surfactant, expressed as the active ingredient amount relative to the total mass of the white ink, is preferably 0.1% by mass or greater, more preferably 0.2% by mass or greater, and further preferably 0.4% by mass or greater. The amount of the surfactant, expressed as the active ingredient amount relative to the total mass of the white ink, is preferably 10% by mass or less, more preferably 5% by mass or less, further preferably 4% by mass or less, and even further preferably 1% by mass or less.

When the white ink contains a nonionic surfactant, the amount of the nonionic surfactant, expressed as the active ingredient amount relative to the total mass of the white ink, is preferably 0.1% by mass or greater, more preferably 0.2% by mass or greater, and further preferably 0.4% by mass or greater. The amount of the nonionic surfactant, expressed as the active ingredient amount relative to the total mass of the white ink, is preferably 5% by mass or less, more preferably 2% by mass or less, and further preferably 1% by mass or less. The amount of the nonionic surfactant, expressed as the active ingredient amount relative to the total mass of the white ink, is preferably within a range from 0.1 to 5% by mass, more preferably from 0.2 to 4% by mass, and further preferably from 0.4 to 1% by mass.

When the white ink contains an acetylene-based surfactant, the amount of the acetylene-based surfactant, expressed as the active ingredient amount relative to the total mass of the white ink, is preferably 0.1% by mass or greater, more preferably 0.2% by mass or greater, and further preferably 0.4% by mass or greater. The amount of the acetylene-based surfactant, expressed as the active ingredient amount relative to the total mass of the white ink, is preferably 5% by mass or less, more preferably 2% by mass or less, and further preferably 1% by mass or less. The amount of the acetylene-based surfactant, expressed as the active ingredient amount relative to the total mass of the white ink, is preferably within a range from 0.1 to 5% by mass, more preferably from 0.2 to 4% by mass, and further preferably from 0.4 to 1% by mass.

The white ink may further contain a water-dispersible resin, a water-soluble resin, or a combination thereof. From the viewpoints of adequately fixing the pigment to the substrate and thereby achieving superior coloration with a small amount of the pigment, the white ink preferably contains at least one selected from among of a water-dispersible resin and a water-soluble resin.

Examples of the water-soluble resin include polyvinyl alcohol, polyacrylic acid, neutralized products of polyacrylic acid, acrylic acid/maleic acid copolymers, acrylic acid/sulfonic acid copolymers, and styrene/maleic acid copolymers. One of these resins may be used alone, or a combination of a plurality of these resins may be used.

The water-dispersible resin is preferably composed of resin particles that can be dispersed in an aqueous solvent. The water-dispersible resin may be added to the ink, for example, in the form of an oil-in-water resin emulsion.

The water-dispersible resin may be either a self-emulsifying resin in which a hydrophilic component has been introduced for stable dispersion in water, or a resin having self-dispersibility by a separate emulsifier.

From the viewpoint of ink jetting properties, the average particle size of the water-dispersible resin is preferably 300 nm or less, more preferably 200 nm or less, and further preferably 150 nm or less. For example, the average particle size of the water-dispersible resin may be within a range from 10 nm to 300 nm.

Here, the average particle size of the resin refers to the volume-based average particle size and is a value measured by the light scattering method.

The water-dispersible resin may be anionic, cationic, nonionic or amphoteric. From the viewpoint of more stably dispersing the water-dispersible resin in the aqueous ink, the water-dispersible resin is preferably anionic or nonionic.

As the water-dispersible resin, an anionic water-dispersible resin having an anionic functional group such as a carboxyl group, a sulfo group or a hydroxyl group is preferable.

In terms of the type of water-dispersible resin, the use of a resin that forms a transparent coating film is preferred. The water-dispersible resin may be added in the form of a resin emulsion, when producing the ink.

Representative examples include urethane resins, (meth) acrylic resins, styrene-(meth)acrylic resins, polyester resins, olefin resins, vinyl chloride resins, vinyl acetate resins, melamine resins, amide resins, ethylene-vinyl chloride copolymer resins, styrene-(meth)acrylic resins, styrene-maleic anhydride copolymer resins, vinyl acetate-(meth)acrylic copolymer resins, vinyl acetate-ethylene copolymer resins, silicone resins, and composite resins of these resins.

The water-dispersible resin is preferably a water-dispersible urethane resin, a water-dispersible polyester resin, or a combination thereof.

Examples of commercially available water-dispersible resins include SUPERFLEX 470 (water-dispersible urethane resin) manufactured by DKS Co. Ltd., and ELITEL KT-9204 (water-dispersible polyester resin) manufactured by Unitika Ltd. (both product names).

One of the water-dispersible resins described above may be used alone or a combination of two or more of the water-dispersible resins described above may be used.

The amount of the water dispersible resin, expressed as a non-volatile fraction amount relative to the total mass of the white ink, is preferably 1% by mass or greater, more preferably 5% by mass or greater, and further preferably 10% by mass or greater. The amount of the water dispersible resin, expressed as a non-volatile fraction amount relative to the total mass of the white ink, is preferably 40% by mass or less, more preferably 30% by mass or less, and further preferably 20% by mass or less. For example, the amount of the water dispersible resin, expressed as a non-volatile fraction amount relative to the total mass of the white ink, is preferably within a range from 1 to 40% by mass, more preferably from 5 to 30% by mass, and further preferably from 10 to 20% by mas.

The mass ratio of non-volatile fraction amounts of the water-dispersible resin relative to a value of 1 for the pigment, is preferably within a range from 0.1 to 10, and more preferably from 1 to 3.

The total amount of the water-dispersible resin and the water-soluble resin, expressed as a non-volatile fraction amount relative to the total mass of the white ink, is preferably 1% by mass or greater, more preferably 5% by mass or greater, and further preferably 10% by mass or greater. The total amount of the water-dispersible resin and the water-soluble resin, expressed as a non-volatile fraction amount relative to the total mass of the white ink, is preferably 40% by mass or less, more preferably 30% by mass or less, and further preferably 20% by mass or less. For example, the total amount of the water-dispersible resin and the water-soluble resin, expressed as a non-volatile fraction amount relative to the total mass of the white ink, is preferably within a range from 1 to 40% by mass, more preferably from 5 to 30% by mass, and further preferably from 10 to 20% by mass.

The mass ratio of non-volatile fraction amounts of the total amount of the water-dispersible resin and the water-soluble resin, relative to a value of 1 for the pigment, is preferably within a range from 0.1 to 10, and more preferably from 1 to 3.

The white ink may contain one or more other components. Examples of such components include pH adjusters and preservatives.

There are no particular limitations on the method used for producing the white ink, and production may be performed using an appropriate conventional method. For example, the ink may be prepared by placing all of the components in a stirring device such as a three-one motor and dispersing the components, either in a single batch or in a number of separate batches, and then, if required, passing the resulting dispersion through a filtration device such as a membrane filter.

The white ink may be used as an aqueous ink for textile inkjet printing.

From the viewpoint of the ink storage stability, the pH of the white ink is preferably within a range from 7.0 to 10.0, and more preferably from 7.5 to 9.0.

The viscosity of the white ink may be adjusted as appropriate, but, for example, from the viewpoint of the jetting properties, the viscosity at 23° C. is preferably within a range from 1 to 30 mPa·s.

From the viewpoint of improving the hiding performance, the surface tension of the white ink at 0.05 Hz is preferably 33 mN/m or greater, more preferably 35 mN/m or greater, and further preferably 35.5 mN/m or greater. From the viewpoint of improving the hiding performance, the surface tension of the white ink at 0.05 Hz is preferably 39 mN/m or less, more preferably 38 mN/m or less, and further preferably 37.5 mN/m or less. When the surface tension of the white ink at 0.05 Hz is 39 mN/m or less, the white ink tends to bleed, so that the area of the white ink covering the substrate tends to increase and the hiding performance tends to be improved.

From the viewpoint of improving the hiding performance, the surface tension of the white ink at 0.05 Hz is preferably within a range from 33 to 39 mN/m, more preferably from 35 to 38 mN/m, and further preferably from 35.5 to 37.5 mN/m.

The surface tension of the white ink at 0.05 Hz can be controlled by, for example, the type and amount of a surfactant, a water-soluble organic solvent, or the like.

From the viewpoint of suppressing permeation at the time of landing of the white ink and thereby improving the hiding performance, the surface tension of the white ink at 10 Hz is preferably 40 mN/m or greater, and more preferably 42 mN/m or greater. The surface tension of the white ink at 10 Hz is preferably 60 mN/m or less, more preferably 55 mN/m or less, and further preferably 50 mN/m or less. The surface tension of the white ink at 10 Hz is, for example, preferably within a range from 40 to 60 mN/m, more preferably from 42 to 55 mN/m, and further preferably from 42 to 50 mN/m.

The surface tension of the white ink at 10 Hz can be controlled by, for example, the type and amount of a surfactant, a water-soluble organic solvent, or the like.

From the viewpoint of efficiently controlling both the surface tension of the white ink at 0.05 Hz and the surface tension of the white ink at 10 Hz so that the surface tension of the white ink at 0.05 Hz is 39 mN/m or less and the surface tension of the white ink at 10 Hz is 40 mN/m or greater, the white ink preferably contains a surfactant.

The difference between the surface tension of the white ink at 10 Hz and the surface tension of the white ink at 0.05 Hz is preferably 1 mN/m or greater, more preferably 2 mN/m or greater, and further preferably 5 mN/m or greater. The difference between the surface tension of the white ink at 10 Hz and the surface tension of the white ink at 0.05 Hz is preferably 15 mN/m or less, more preferably 12 mN/m or less, and further preferably 10 mN/m or less. The difference between the surface tension of the white ink at 10 Hz and the surface tension of the white ink at 0.05 Hz is, for example, preferably within a range from 1 to 15 mN/m, more preferably from 2 to 12 mN/m, and further preferably from 5 to 10 mN/m.

The surface tension of the white ink at 0.05 Hz is a dynamic surface tension at a frequency of 0.05 Hz, and is a value determined at 23° C. The surface tension of the white ink at 0.05 Hz can be determined by the maximum bubble pressure method under the measurement conditions of 23° C. and 0.05 Hz. The surface tension of the white ink at 10 Hz is a dynamic surface tension at a frequency of 10 Hz and is a value determined at 23° C. The surface tension of the white ink at 10 Hz can be determined by the maximum bubble pressure method under the measurement conditions of 23° C. and 10 Hz. For these measurements, for example, the Science Line t60 device manufactured by SITA Process Solutions of SITA Messtechnik GmbH can be used.

The specific gravity of the white ink is preferably 1.050 or greater, and more preferably 1.100 or greater. The specific gravity of the white ink is preferably 1.300 or less, and more preferably 1.200 or less. The specific gravity of the white ink is preferably within a range from 1.050 to 1.300, and more preferably from 1.100 to 1.200.

The specific gravity of the white ink is a value determined at 23° C., and can be determined by the same method as that for the specific gravity of the pretreatment liquid.

The specific gravity of the white ink can be controlled by, for example, the type and amount of the pigment.

<Color Ink>

Examples of the color inks include inks other than a white ink, such as a magenta ink, a cyan ink, a yellow ink and a black ink.

The color ink may contain a pigment, a dye, or a combination thereof, as a colorant. The color ink preferably contains a pigment.

For the pigment, the color ink preferably contains a non-white pigment.

Examples of non-white pigments include organic pigments, examples of which include azo-based pigments, phthalocyanine-based pigments, dye-based pigments, condensed polycyclic pigments, nitro-based pigments and nitroso-based pigments (with specific examples including brilliant carmine 6B, lake red C, Watchung red, disazo yellow, Hansa yellow, phthalocyanine blue, phthalocyanine green, alkali blue and aniline black); inorganic pigments, examples of which include metals such as cobalt, iron, chromium, copper, zinc, lead, titanium, vanadium, manganese and nickel, as well as metal oxides and sulfides, and yellow ocher, ultramarine and iron blue pigments; and carbon blacks, examples of which include furnace carbon black, lamp black, acetylene black and channel black.

From the viewpoint of color development, the average particle size of the pigment is preferably 50 nm or greater. From the viewpoint of the jetting stability, the average particle size of the pigment is preferably 500 nm or less. For example, the average particle size of the pigment is preferably within a range from 50 to 500 nm, and more preferably from 50 to 200 nm.

A self-dispersing pigment may be used as the pigment. The self-dispersing pigment is preferably a pigment in which a hydrophilic functional group is introduced by a chemical treatment or physical treatment. The hydrophilic functional group introduced into the self-dispersing pigment preferably has ionicity. By anionically or cationically charging the pigment surface, the pigment particles may be stably dispersed in water by electrostatic repulsion. Examples of preferred anionic functional groups include a sulfo group, a carboxyl group, a carbonyl group, a hydroxyl group, and a phosphonic acid group. Examples of preferred cationic functional groups include a quaternary ammonium group, and a quaternary phosphonium group.

These hydrophilic functional groups may be bonded directly to the pigment surface, or bonded via another group of atoms. Examples of this other group of atoms include an alkylene group, a phenylene group and a naphthylene group, but this is not an exhaustive list. Examples of the method used for treating the pigment surface include a diazotization treatment, a sulfonation treatment, a hypochlorous acid treatment, a humic acid treatment, and a vacuum plasma treatment.

Preferable examples of commercially available self-dispersing pigments include CAB-O-JET 200, CAB-O-JET 300, CAB-O-JET 250C, CAB-O-JET 260M, CAB-O-JET 270, CAB-O-JET 450E and the like of the CAB-O-JET series manufactured by Cabot Corporation, and BONJET BLACK CW-1, BONJET BLACK CW-2, BONJET BLACK CW-3, and BONJET BLACK CW-4 manufactured by Orient Chemical Industries, Ltd. (all product names).

A microencapsulated pigment in which the pigment is coated with a resin may be used as the pigment.

Pigment dispersions in which the pigment has been dispersed in advance using a pigment dispersant may be used. Examples of commercially available pigment dispersions in which the pigment has been dispersed using a pigment dispersant include the HOSTAJET series manufactured by Clariant AG, and the FUJI SP series manufactured by Fuji Pigment Co., Ltd. Pigment dispersions that have been dispersed using a pigment dispersant described below may also be used.

The color ink may contain a dye as a colorant. In terms of dyes, any of the dyes typically used in the technical field of printing may be used without any particular limitations. Specific examples include basic dyes, acid dyes, direct dyes, soluble vat dyes, acid mordant dyes, mordant dyes, reactive dyes, vat dyes and sulfide dyes, and among these, water-soluble dyes and dyes that become water-soluble upon reduction or the like may be preferably used. More specific examples of dyes include azo dyes, rhodamine dyes, methine dyes, azomethine dyes, xanthene dyes, quinone dyes, triphenylmethane dyes, diphenylmethane dyes, and methylene blue.

A single colorant may be used alone, or a combination of two or more colorants may be used.

The amount of the colorant may vary depending on the type of colorant, but from the viewpoints of the hiding performance, the color development and the like, the amount of the colorant, expressed as the active ingredient amount (the concentration of the colorant such as a pigment) relative to the total mass of the color ink, is preferably 0.1% by mass or greater, more preferably 1% by mass or greater, and further preferably 3% by mass or greater. The amount of the colorant (the concentration of the colorant) relative to the total mass of the color ink, is preferably 30% by mass or less, more preferably 25% by mass or less, further preferably 15% by mass or less, and even further preferably 10% by mass or less. The amount of the colorant (the concentration of the colorant) relative to the total mass of the color ink, is preferably within a range from 0.1 to 30% by mass, more preferably from 1 to 25% by mass, further preferably from 3 to 15% by mass, and even further preferably from 3 to 10% by mass.

When the color ink contains a pigment as a colorant, a pigment dispersant typified by polymeric dispersants and surfactant-type dispersants is preferably used to ensure stable dispersion of the pigment in the color ink.

As the pigment dispersant, for example, one pigment dispersant or a combination of two or more pigment dispersants, selected from among the pigment dispersants that may be used in the white ink as described above, may be used.

When the pigment dispersant is incorporated in the color ink, there are no particular limitations on the amount of the pigment dispersant, which may vary depending on the type of pigment dispersant used. In general, the mass ratio of the pigment dispersant (active ingredient) relative to a value of 1 for the pigment (pigment concentration) is preferably within a range from 0.005 to 0.5.

The color ink preferably contains water as an aqueous solvent, and the main solvent may be water.

There are no particular limitations on this water, but water containing minimal ionic components is preferred. From the viewpoint of the ink storage stability, the amount of polyvalent metal ions such as calcium ions is preferably kept low. Examples of the water include ion-exchanged water, distilled water and ultra-pure water.

From the viewpoint of the ink viscosity adjustment, the amount of water, relative to the total mass of the color ink, is preferably within a range from 20 to 80% by mass, and more preferably from 30 to 70% by mass.

The color ink may contain a water-soluble organic solvent together with or in place of water.

From the viewpoints of the ink viscosity adjustment and the moisture retention effects, the water-soluble organic solvent is preferably a water-soluble organic solvent that is liquid at room temperature and soluble in water.

As the water-soluble organic solvent, for example, one water-soluble organic solvent or a combination of two or more water-soluble organic solvents, selected from among the water-soluble organic solvents that may be used in the pretreatment liquid as described above, may be used.

When two or more water-soluble organic solvents are used, these water-soluble organic solvents, together with water, preferably form a single phase.

From the viewpoints of the ink viscosity adjustment and the moisture retention effects, the amount of the water-soluble organic solvent, relative to the total mass of the color ink, is preferably within a range from 1 to 50% by mass, and more preferably from 10 to 40% by mass. The amount of the water-soluble organic solvent, relative to the total mass of the color ink, is preferably 1% by mass or greater, and more preferably 10% by mass or greater. The amount of the water-soluble organic solvent, relative to the total mass of the color ink, is preferably 50% by mass or less, and more preferably 40% by mass or less.

The color ink preferably contains a surfactant.

Any surfactant selected from among anionic surfactants, cationic surfactants, amphoteric surfactants, and nonionic surfactants may be used as the surfactant. From the viewpoint of preventing foaming of the ink, the use of a nonionic surfactant is preferred. The surfactant may be a low-molecular weight surfactant or a high-molecular weight surfactant.

The HLB value of the surfactant is preferably within a range from 5 to 20, and more preferably from 10 to 18.

As the surfactant, for example, one surfactant or a combination of two or more surfactants, selected from among the surfactants that may be incorporated in the pretreatment liquid as described above, may be used.

The amount of the surfactant (in those cases where the ink further contains a surfactant as a pigment dispersant, the total amount including the amount of the surfactant as a pigment dispersant) may vary depending on the type of dispersant, but from the viewpoints of the surface tension of the color ink and the permeability of the color ink to the fabric, the amount of the surfactant, expressed as the active ingredient amount relative to the total mass of the color ink, is preferably within a range from 0.1 to 10% by mass, and more preferably from 0.2 to 5% by mass.

The color ink may further contain a water-dispersible resin, a water-soluble resin, or a combination thereof. From the viewpoints of adequately fixing the colorant to the substrate and thereby obtaining high coloring properties with a small amount of the colorant, the color ink preferably contains at least one selected from the group consisting of a water-dispersible resin and a water-soluble resin.

As the water-soluble resin, for example, one resin or a combination of two or more resins, selected from among the water-soluble resins that may be incorporated in the white ink described above, may be used.

The water-dispersible resin is preferably composed of resin particles that can be dispersed in an aqueous solvent. The water-dispersible resin can be added into an ink, for example, in the form of an oil-in-water resin emulsion.

The water-dispersible resin may be either a self-emulsifying resin in which a hydrophilic component is introduced for stable dispersion in water, or a resin having self-dispersibility by a separate emulsifier.

From the viewpoint of the ink jetting properties, the average particle size of the water-dispersible resin is preferably 300 nm or less, more preferably 200 nm or less, and further preferably 150 nm or less. For example, the average particle size of the water-dispersible resin may be within the range from 10 nm to 300 nm.

Here, the average particle size of the resin refers to the volume-based average particle size and is a value measured by the light scattering method.

The water-dispersible resin may be anionic, cationic, nonionic or amphoteric. From the viewpoint of more stably dispersing the water-dispersible resin in the aqueous ink, the water-dispersible resin is preferably anionic or nonionic.

As the water-dispersible resin, an anionic water-dispersible resin having an anionic functional group such as a carboxyl group, a sulfo group or a hydroxyl group is preferable.

In terms of the type of the water-dispersible resin, the use of a resin that forms a transparent coating film is preferred. The water-dispersible resin may be added in the form of a resin emulsion, when producing the ink.

As the water-dispersible resin, for example, one water-dispersible resin or a combination of two or more water-dispersible resins, selected from among the water-dispersible resins that may be incorporated in the white ink described above, may be used. The water-dispersible resin is preferably a water-dispersible urethane resin.

One of the above-described water-dispersible resins may be used alone, or a combination of two or more of the above-described water-dispersible resins may be used.

The amount of the water-dispersible resin, expressed as a non-volatile fraction amount relative to the total mass of the color ink, is preferably 1% by mass or greater, more preferably 3% by mass or greater, and further preferably 5% by mass or greater.

The amount of the water-dispersible resin, expressed as a non-volatile fraction amount relative to the total mass of the color ink, is preferably 30% by mass or less, and more preferably 20% by mass or less.

For example, the amount of the water-dispersible resin, expressed as a non-volatile fraction amount relative to the total mass of the ink, is preferably within a range from 1 to 30% by mass, more preferably from 3 to 30% by mass, and further preferably from 5 to 20% by mass.

The mass ratio of non-volatile fraction amounts of the water-dispersible resin relative to a value of 1 for the colorant is preferably within a range from 0.1 to 10, and more preferably from 1 to 3.

The total amount of the water-dispersible resin and the water-soluble resin, expressed as a non-volatile fraction amount relative to the total mass of the color ink, is preferably 1% by mass or greater, more preferably 3% by mass or greater, and further preferably 5% by mass or greater. The total amount of the water-dispersible resin and the water-soluble resin, expressed as a non-volatile fraction amount relative to the total mass of the color ink, is preferably 40% by mass or less, more preferably 30% by mass or less, and further preferably 20% by mass or less.

For example, the total amount of the water-dispersible resin and the water-soluble resin, expressed as a non-volatile fraction amount relative to the total mass of the color ink, is preferably within a range from 1 to 40% by mass, more preferably from 3 to 30% by mass, and further preferably from 5 to 20% by mass.

The mass ratio of non-volatile fraction amounts of the total amount of the water-dispersible resin and the water-soluble resin relative to a value of 1 for the colorant is preferably within a range from 0.1 to 10, and more preferably from 1 to 3.

The color ink may contain one or more other components. Examples of such components include pH adjusters and preservatives.

There are no particular limitations on the method used for producing the color ink, and production may be performed using an appropriate conventional method. For example, the ink may be prepared by placing all of the components in a stirring device such as a three-one motor and dispersing the components, either in a single batch or in a number of separate batches, and then, if required, passing the resulting dispersion through a filtration device such as a membrane filter.

The color ink may be used as an aqueous ink for textile printing. More preferably, the color ink may be used as an aqueous ink for textile inkjet printing.

From the viewpoint of the ink storage stability, the pH of the color ink is preferably within a range from 7.0 to 10.0, and more preferably from 7.5 to 9.0.

The viscosity of the color ink may be adjusted as appropriate, but, for example, from the viewpoint of the jetting properties, the viscosity at 23° C. is preferably within a range from 1 to 30 mPa·s.

<Method for Producing Printed Textile Item>

The method for producing a printed textile item according to an embodiment may include applying the pretreatment liquid as described above to the fabric, and, after the application of the pretreatment liquid, applying the white ink as described above to the fabric by an inkjet method. The application of the white ink may be performed within 100 seconds from the application of the pretreatment liquid and by a wet-on-wet method.

The application region of the pretreatment liquid may be a region corresponding to the region where an image is formed using the white ink. The pretreatment liquid may be applied to a part of or entire region of the fabric. The pretreatment liquid is preferably applied to at least a part of the region where an image is to be formed using the white ink.

There are no particular limitations on the method for applying the pretreatment liquid to the fabric, and examples of the methods include a spraying method (for example, using an airbrush or the like), a dipping method, a padding method, and a coating method. Examples of the methods for applying the pretreatment liquid further include various printing methods such as inkjet printing (inkjet method) and screen printing.

As the inkjet printer for applying the pretreatment liquid by an inkjet method, an inkjet printer that may be used as an inkjet printer for applying the ink to a fabric, which is described below, may be used. In the case of using an inkjet method, for example, liquid droplets of the pretreatment liquid may be preferably jetted from the inkjet head based on the digital signal, with the jetted droplets being adhered to the fabric.

The amount of the pretreatment liquid applied to the fabric is preferably within a range from 10 to 300 g/m$^2$, more preferably from 20 to 200 g/m$^2$, and further preferably from 30 to 150 g/m$^2$. From the viewpoint of the hiding performance, the amount of the pretreatment liquid applied to the fabric is preferably 10 g/m$^2$ or greater, more preferably 20 g/m$^2$ or greater, and further preferably 30 g/m$^2$ or greater. On the other hand, from the viewpoint of image quality, the amount of the pretreatment liquid applied to the fabric is preferably 300 g/m$^2$ or less, more preferably 200 g/m$^2$ or less, and further preferably 150 g/m$^2$ or less.

The amount of the pretreatment liquid applied to the fabric, expressed as the active ingredient amount of the coagulant, is preferably within a range from 1 to 100 g/m$^2$, more preferably from 5 to 80 g/m$^2$, and further preferably from 10 to 50 g/m$^2$.

The white ink may be applied to the fabric by an inkjet method.

The inkjet printer used for applying the white ink to the fabric by an inkjet method may be of any of various systems, including a piezoelectric system, an electrostatic system, or a thermal system. For example, ink droplets are preferably jetted from the inkjet head based on a digital signal, with the jetted ink droplets being adhered to a fabric.

Although there are no particular limitations on the amount of the white ink applied to the fabric, the amount of the white ink applied per unit area of the fabric is preferably 500 g/m$^2$ or less, more preferably 400 g/m$^2$ or less, and further preferably 300 g/m$^2$ or less. The amount of the white ink applied to the fabric is preferably 10 g/m$^2$ or greater, more preferably 50 g/m$^2$ or greater, and further preferably 100 g/m$^2$ or greater. The amount of the white ink applied to the fabric is, for example, preferably within a range from 10 to 500 g/m$^2$, more preferably from 50 to 400 g/m$^2$, and further preferably from 100 to 300 g/m$^2$.

After the application of the pretreatment liquid, the white ink is preferably applied to the fabric by a wet-on-wet method. Specifically, the white ink is preferably applied to the fabric without performing a drying step such as heat drying, after applying the pretreatment liquid. The temperature of the surface of the fabric during the time period after the application of the pretreatment liquid to the application of the white ink is preferably 40° C. or lower, and more preferably 35° C. or lower. After the application of the pretreatment liquid, the white ink is preferably applied in a state where the remaining amount of the volatile fraction of the pretreatment liquid on the fabric is 90% by mass or greater.

The application of the white ink is preferably performed within 100 seconds from the application of the pretreatment liquid and by a wet-on-wet method. The term "within 100 seconds from the application of the pretreatment liquid" means that the time period between the time (timing) at which the pretreatment liquid is applied to a certain point on the substrate (fabric) in the application target area and the time at which a droplet of white ink lands on that point (which may hereinafter be referred to as "the time period from the application of the pretreatment liquid to the application of the white ink") is within 100 seconds. In those cases where the pretreatment liquid and the white ink are printed in a plurality of passes by an inkjet method, the "time period from the application of the pretreatment liquid to the application of the white ink" refers to the time period between the time at which the first droplet of the pretreatment liquid lands at a point in the application area on the substrate (fabric) and the time at which the first droplet of the white ink lands at that point.

For example, in those cases where the pretreatment liquid is applied by an ink jet method, the time period from the application of the pretreatment liquid to the application of the white ink may be adjusted by adjusting, for example, the distance between the nozzles of the ink jet head for jetting the pretreatment liquid and the nozzles of the ink jet head for jetting the white ink, the inkjet head scanning speed, the inkjet head scanning distance, the inkjet head jetting speed and/or the inkjet head jetting timing.

From the viewpoint of improving the hiding performance, the time period from the application of the pretreatment liquid to the application of the white ink is preferably 100 seconds or less, more preferably 95 seconds or less, and further preferably 50 seconds or less. The time period from the application of the pretreatment liquid to the application of the white ink may be, for example, 20 seconds or less, or 10 seconds or less.

The time period from the application of the pretreatment liquid to the application of the white ink is, for example, preferably 1 second or greater, more preferably 3 seconds or greater, and further preferably 5 seconds or greater.

The time period from the application of the pretreatment liquid to the application of the white ink may be, for example, within a range from 1 to 100 seconds, from 1 to 95 seconds, from 1 to 50 seconds, from 3 to 50 seconds, from 3 to 20 seconds, from 5 to 20 seconds, or from 3 to 10 seconds.

In those cases where the surface tension of the white ink at 0.05 Hz is within a range from 33 to 39 mN/m, the more the time period from the application of the pretreatment liquid to the application of the white ink is shortened, the more the amount of the pretreatment liquid that can react with the white ink per unit area tends to increase, and the more the hiding performance tends to improve.

For example, in some embodiments, the surface tension of the white ink at 0.05 Hz may be within a range from 33 to 39 mN/m, more preferably from 35 to 38 mN/m, and the time period from the application of the pretreatment liquid to the application of the white ink may be within a range from 1 to 50 seconds.

In those cases where the surface tension of the white ink at 0.05 Hz is low, the white ink applied to the fabric tends to bleed easily, and, therefore, if the time period from the application of the pretreatment liquid to the application of the white ink is small, the white ink may, before the pretreatment liquid bleeds, spread beyond the area in which the pretreatment liquid has been adhered, and the hiding performance may decline. For example, in those cases where the surface tension of the white ink at 0.05 Hz is less than 35 mN/m, from the viewpoint of further improving the hiding performance, the time period from the application of the pretreatment liquid to the application of the white ink is preferably 5 seconds or greater, more preferably 10 seconds or greater, and further preferably 20 seconds or greater.

In those cases where the surface tension of the white ink at 0.05 Hz increases, the white ink may be less likely to permeate or bleed, and the amount of the pretreatment liquid required tends to decrease. Therefore, the influence of permeation and bleeding of the pretreatment liquid over time may become smaller, and the influence of the time period from the application of the treatment liquid to the application of the white ink on the hiding performance may become smaller.

The method for producing a printed textile item preferably includes heating the fabric, after the application of the white ink to the fabric.

The heating temperature for heating the fabric to which the white ink has been applied may be appropriately selected depending on the material of the fabric. The heating temperature for heating the fabric to which the white ink has been applied is preferably 100° C. or higher, and more preferably 150° C. or higher. From the viewpoint of reducing damages to the fabric, the heating temperature for heating the fabric to which the white ink has been applied is preferably 200° C. or lower.

There are no particular limitations on the device used for heating the fabric to which the white ink has been applied. Examples of the device include a heat press, a roll heater, a hot air device, and an infrared lamp heater. Any of these heating devices may be provided integrally with an inkjet printer.

The heating time for heating the fabric to which the white ink has been applied may be appropriately set according to the heating method or the like. For example, in the case of heat pressing, the heating time is preferably within a range from 1 second to 10 minutes, and may be, for example, within a range from 5 seconds to 5 minutes.

The method for producing the printed textile item preferably further includes applying the color ink as described above, after the application of the white ink.

Since excellent substrate hiding performance may be exhibited by the method for producing the printed textile item of one embodiment, in those cases where the color ink is applied after the application of the white ink, it is possible to produce a printed textile item in which an image excellent in color development is formed.

There are no particular limitations on the method for applying the color ink to the fabric, and examples of the method include a spraying method (for example, using an airbrush), a dipping method, a padding method, and a coating method. Examples of the methods for applying the color ink further include various printing methods such as inkjet printing (inkjet method). The use of inkjet printing is preferable.

As the inkjet printer for applying the color ink by an inkjet method, for example, an inkjet printer that may be used as the inkjet printer for applying the white ink to the fabric as described above may be used. In the case of using an inkjet method, for example, ink droplets may be preferably jetted from the inkjet head based on the digital signal, with the jetted ink droplets being adhered to the fabric.

There are no particular limitations on the amount of color ink applied to the fabric, but the amount of the color ink applied per unit area of the fabric is preferably 100 $g/m^2$ or less, more preferably 50 $g/m^2$ or less, and further preferably 30 $g/m^2$ or less.

Although there are no particular limitations on the amount of the color ink applied to the fabric, from the viewpoint of image density, the amount of the color ink applied to the fabric is preferably 1 $g/m^2$ or greater, more preferably 3 $g/m^2$ or greater, and further preferably 5 $g/m^2$ or greater. For example, the amount of color ink applied to the fabric is preferably within a range from 1 to 100 $g/m^2$, more preferably from 3 to 50 $g/m^2$, and further preferably 4 to 30 $g/m^2$.

The color ink is preferably applied to the fabric by a wet-on-wet method after applying the white ink. Specifically, the color ink is preferably applied to the fabric without performing a drying step such as heat drying after the application of the white ink. The temperature of the surface of the fabric during the time period after the application of the white ink to the beginning of the application of the color ink is preferably 40° C. or lower, and more preferably 35° C. or lower. After the application of the white ink, the color ink is preferably applied in a state where the remaining amount of the volatile fraction of the white ink on the fabric is 90% by mass or greater.

The method for producing a printed textile item preferably includes heating the fabric after the application of the color ink to the fabric.

The heating temperature for heating the fabric to which the color ink has been applied may be appropriately selected depending on the material of the fabric. The heating temperature for heating the fabric to which the color ink has been applied is preferably 100° C. or higher, and more preferably 150° C. or higher. From the viewpoint of reducing damages to the fabric, this heating temperature is preferably 200° C. or lower.

The heating time for heating the fabric to which the color ink has been applied may be appropriately set according to the heating method or the like. For example, in the case of heat pressing, the heating time is preferably within a range from 1 second to 10 minutes, and may be, for example, within a range from 5 seconds to 5 minutes.

There are no particular limitations on the device for heating the fabric to which the color ink has been applied, and examples of the devices include those described for the devices for heating the fabric to which the white ink has been applied as described above.

The method for producing a printed textile item may include, after the application of the color ink to the fabric, applying a post-treatment liquid. The method for producing a printed textile item may include, after the application of the color ink, heating the fabric, and, after that, applying a post-treatment liquid. The method for producing a printed textile item may include, after the application of the color ink, applying a post-treatment liquid by a wet-on-wet method. The method for producing a printed textile item may include, after the application of the post-treatment liquid heating the fabric.

<Ink Set>

According to one embodiment, an ink set for textile inkjet printing is provided, the ink set including a pretreatment liquid containing a coagulant, water and a surfactant, and a white ink containing a white pigment and water.

As the pretreatment liquid and the white ink, the pretreatment liquid and the white ink which may be used in the method for producing the printed textile item described above may be used, respectively.

The ink set for textile inkjet printing may further include a color ink. As the color ink, the color ink which may be used in the above-described method for producing printed textile item may be used.

The ink set for textile inkjet printing may further include, for example, a post-treatment liquid and the like.

Examples

The present invention is described below in further detail based on a series of examples, but the present invention is not limited to only these examples. Unless specifically stated otherwise, "%" represents "% by mass".

<Production of Pretreatment Liquid>

Table 1 shows the raw materials and physical properties (specific gravity) of pretreatment liquids UC1 to UC4. For those raw materials that contain a solvent or the like within the material, the amount of the material shown in the table represents the amount including the solvent or the like included in the material. The raw materials shown in Table 1 were mixed in the blend ratios shown in Table 1, thus obtaining the pretreatment liquids.

The specific gravity of each pretreatment liquid shown in Table 1 is a value measured at 23° C. using a portable density/specific gravity meter DA-130N manufactured by Kyoto Electronics Manufacturing Co., Ltd.

TABLE 1

| Raw materials (% by mass) | | Active ingredient | Pretreatment liquid UC1 | Pretreatment liquid UC2 | Pretreatment liquid UC3 | Pretreatment liquid UC4 |
|---|---|---|---|---|---|---|
| Coagulant | Calcium nitrate tetrahydrate | 69% | 29.0 | 23.0 | 14.5 | |
| | Calcium chloride | 100% | | | | 20.0 |
| Water-soluble organic solvent | 1,3-propanediol | | 24.0 | 24.0 | 24.0 | |
| | Diethylene glycol | | | | | 24.0 |
| Surfactant | Surfynol 485 | 100% | | | | 1.0 |
| | OLFINE E 1030W | 75% | 1.0 | 1.0 | 1.0 | |
| Water | Ion-exchanged water | | 46.0 | 52.0 | 60.5 | 55.0 |
| Total (% mass) | | | 100.0 | 100.0 | 100.0 | 100.0 |
| Specific gravity | | | 1.182 | 1.150 | 1.104 | 1.160 |

Details of the raw materials shown in Table 1 are as follows.

(Coagulants)

Calcium nitrate tetrahydrate: manufactured by FUJIFILM Wako Pure Chemical Corporation, active ingredient (as anhydrate): 69% by mass Calcium chloride: FUJIFILM Wako Pure Chemical Corporation, active ingredient: 100% by mass (Water-Soluble Organic Solvents)

1,3-propanediol: manufactured by FUJIFILM Wako Pure Chemical Corporation

Diethylene glycol: manufactured by FUJIFILM Wako Pure Chemical Corporation (Surfactants)

Surfynol 485: an acetylene-based surfactant, manufactured by Evonik Industries, active ingredient: 100%

OLFINE E 1030W: an acetylene-based surfactant, manufactured by Nissin Chemical Industry Co., Ltd., active ingredient: 75% by mass <Production of White Ink>

Table 2 shows the raw materials and physical properties (the surface tension and the specific gravity) of white inks W1 to W6. For those raw materials that contain a solvent or the like within the material, the amount of the material shown in the table represents the amount including the solvent or the like included in the material.

The raw materials shown in Table 2 were mixed together in the blend ratio shown in Table 2, and the resulting mixture was filtered through a membrane filter having a pore diameter of 3 μm, thus obtaining a series of white inks.

The surface tension of each white ink at 0.05 Hz shown in Table 2 was determined using a Science Line t60 device manufactured by SITA Process Solutions of SITA Messtechnik GmbH under the measurement conditions of 23° C. and 0.05 Hz. The surface tension of each white ink at 10 Hz shown in Table 2 was determined using the Science Line t60 device manufactured by SITA Process Solutions of SITA Messtechnik GmbH under the measurement conditions of 23° C. and 10 Hz.

The specific gravity of each white ink shown in Table 2 is a value measured at 23° C. using a portable density/specific gravity meter "DA-130N" manufactured by Kyoto Electronics Manufacturing Co., Ltd.

TABLE 2

| Raw materials (% by mass) | | Active ingredient | White Ink W1 | White Ink W2 | White Ink W3 | White Ink W4 | White Ink W5 | White Ink W6 |
|---|---|---|---|---|---|---|---|---|
| Pigment dispersion | White pigment dispersion | 35% | 28.0 | 28.0 | 28.0 | 28.0 | 28.0 | 28.0 |
| Water-dispersible resin | SUPERFLEX 470 | 38% | 26.0 | 26.0 | 26.0 | 26.0 | 26.0 | 26.0 |
| | ELITEL KT-9204 | 30% | 20.0 | 20.0 | 20.0 | 20.0 | 20.0 | 20.0 |
| Water-soluble organic solvent | Glycerin | | 5.0 | 5.0 | 5.0 | 5.0 | 5.0 | 5.0 |
| | 1,3-propanediol | | 15.0 | 15.0 | 15.0 | 15.0 | | 5.0 |
| | Diethylene glycol | | | | | | 15.0 | |
| | Diethylene glycol monobutyl ether | | | | | | | 10.0 |
| surfactant | Surfynol 465 | | 0.7 | 0.2 | 1.4 | 2.1 | | |
| | OLFINE E1010 | | | | | | 0.7 | |
| Water | Ion-exchanged water | | 5.3 | 5.8 | 4.6 | 3.9 | 5.3 | 6.0 |
| Total (% by mass) | | | 100.0 | 100.0 | 100.0 | 100.0 | 100.0 | 100.0 |
| Surface tension (mN/m) at 10 Hz | | | 45.5 | 50.1 | 43.7 | 40.8 | 45.8 | 38.3 |
| Surface tension (mN/m) at 0.05 Hz | | | 36.7 | 39.7 | 33.3 | 31.3 | 36.9 | 34.7 |
| Specific gravity | | | 1.140 | 1.140 | 1.139 | 1.139 | 1.140 | 1.150 |

Details of the materials shown in Table 2 are as follows.

(Pigment Dispersion)

White pigment dispersion: obtained by the method shown below, pigment content: 35% by mass (Water-Dispersible Resin)

SUPERFLEX 470: a water-dispersible urethane resin (aqueous resin emulsion), manufactured by DKS Co., Ltd., active ingredient: 38% by mass ELITEL KT-9204: a water-dispersible polyester resin (aqueous resin emulsion), manufactured by Unitika Ltd., active ingredient: 30% by mass (Water-Soluble Organic Solvents)

Glycerin: manufactured by FUJIFILM Wako Pure Chemical Corporation 1,3-propanediol: manufactured by FUJIFILM Wako Pure Chemical Corporation Diethylene glycol: manufactured by FUJIFILM Wako Pure Chemical Corporation Diethylene glycol monobutyl ether: manufactured by FUJIFILM Wako Pure Chemical Corporation (Surfactants)

Surfynol 465: an acetylene-based surfactant, manufactured by Evonik Industries, active ingredient: 100% by mass OLFINE E1010: an acetylene-based surfactant, manufactured by Nissin Chemical Industry Co., Ltd., active ingredient: 100% by mass <Production of White Pigment Dispersion>

Using 350 g of titanium oxide TIPAQUE R-980 (manufactured by Ishihara Sangyo Kaisha, Ltd.) as a white pigment and 17.5 g (active ingredient: 3.5 g) of DEMOL P (manufactured by Kao Corporation), these components were mixed with 632.5 g of ion-exchanged water, and the resulting mixture was dispersed using a beads mill (model: DYNO-MILL KDL A, manufactured by Shinmaru Enterprises Corporation) containing 0.5 mmΦ zirconia beads at a packing ratio of 80%, under the conditions including a residence time of 2 minutes, thus yielding a pigment dispersion (a pigment content: 35% by mass). The thus obtained pigment dispersion was used as the white pigment dispersion.

<Production of Color Ink>

Table 3 shows the raw materials of color ink C1. For those raw materials that contain a solvent or the like within the material, the amount of the material shown in the table represents an amount of the material including the amount of the solvent or the like included in the material.

The raw materials shown in Table 3 were mixed together in the blend ratio shown in Table 3, and the resulting mixture was filtered through a membrane filter having a pore diameter of 3 μm, thus obtaining the color ink.

TABLE 3

| Raw materials (% by mass) | | Active ingredient | Color Ink C1 |
|---|---|---|---|
| Pigment dispersion | CAB-O-JET450C | 15% | 33.3 |
| Water-dispersible resin | SUPERFLEX 470 | 38% | 26.3 |
| Water-soluble organic solvent | Glycerin | | 15.0 |
| | Diethylene glycol | | 15.0 |
| Surfactant | OLFINE E1010 | 100% | 1.0 |
| Water | Ion-exchanged water | | 9.4 |
| | Total (% by mass) | | 100.0 |

Details of the materials shown in Table 3 are as follows.

(Pigment Dispersion)

CAB-O-JET 450C: A self-dispersing pigment dispersion (cyan), manufactured by Cabot Corporation, pigment content: 15% by mass (Water-Dispersible Resin)

SUPERFLEX 470: a water-dispersible urethane resin (aqueous resin emulsion), manufactured by DKS CO., LTD., active ingredient: 38% by mass (Water-Soluble Organic Solvents)

Glycerin: manufactured by FUJIFILM Wako Pure Chemical Corporation

Diethylene glycol: manufactured by FUJIFILM Wako Pure Chemical Corporation (Surfactants)

OLFINE E1010: an acetylene-based surfactant, manufactured by Nissin Chemical Industry Co., Ltd., active ingredient: 100% by mass <Production of White Printed Textile Items>

Tables 4 and 5 show the pretreatment liquids and the white inks used in the production of the white printed textile items of Example 1 to 8 and Comparative Example 1 to 7. In Tables 4 and 5, "Ex" denotes "Example", and "CEx" denotes "Comparative Example".

The white printed textile item of Example 1 to 8 and Comparative Example 1 to 7 were produced as follows.

A black cotton T-shirt (product name "Printstar") manufactured by Toms Co., Ltd. was used as a substrate. The pretreatment liquid and the white ink were applied to the substrate in this order by a wet-on-wet method using an inkjet printer "MMP-8130" manufactured by Mastermind Inc., thus forming a solid image of the white ink on the substrate. The amounts of the pretreatment liquid applied to the substrate were 50 g/m$^2$ for the pretreatment liquid UC1, 125 g/m$^2$ for the pretreatment liquid UC2, 100 g/m$^2$ for the pretreatment liquid UC3, and 84 g/m$^2$ for the pretreatment liquid UC4. The amount of the white ink applied to the substrate was 200 g/m$^2$ in each of Examples 1 to 8 and Comparative Examples 1 to 7.

Then, heat drying was performed at 160° C. for 2 minutes using a Hotronix Fusion heat press, thus obtaining the white printed textile items.

In Tables 4 and 5, in Examples 1 to 8 and Comparative Examples 1 to 7, the "time period from the application of the pretreatment liquid to the application of the white ink" was adjusted by changing the image size to change the scanning distance (the scanning distance in the main scanning direction) of the inkjet head.

<Production of Color Printed Textile Items>

In the production of the white printed textile items of Examples 1 to 4 and Comparative Examples 1 to 7 as described above, after the application of the white ink, the drying using the heat press was not performed, and the color ink C1 (cyan ink) produced as described above was printed by a wet-on-wet method at an application amount of 12 g/m$^2$ using an inkjet printer "MMP-8130" manufactured by Mastermind Inc.

Thereafter, heat drying was performed at 160° C. for 2 minutes using a Hotronix Fusion heat press, thus obtaining the color printed textile items.

<Evaluation>

(Hiding Performance)

The white printed textile items of Examples 1 to 8 and Comparative Examples 1 to 7 were inspected visually and the hiding performance was evaluated against the following evaluation criteria. The results are shown in Tables 4 and 5.

S: The solid image of the white ink of the white printed textile item does not have a part through which the color of the substrate can be seen.

A: The solid image of the white ink of the white printed textile item has a part through which the color of the substrate can be seen.

B: The solid image of the white ink of the white printed textile item has a part through which the color of the substrate can be seen to a notable extent.

(Color Development)

The color printed textile items of Examples 1 to 4 and Comparative Examples 1 to 7 were inspected visually and the color development was evaluated against the following evaluation criteria. The results are shown in Tables 6 and 7.

S: The color of the substrate is less visible, and the color development of the color ink is good.

A: The color of the substrate is slightly visible, but the color development of the color ink is good.

B: The color of the substrate is noticeable, and the color development of the color ink is poor.

TABLE 4

| | Ex 1 | Ex 2 | Ex 3 | Ex 4 | Ex 5 | Ex 6 | Ex 7 | Ex 8 |
|---|---|---|---|---|---|---|---|---|
| Pretreatment liquid | UC1 | UC1 | UC1 | UC1 | UC1 | UC1 | UC2 | UC4 |
| White ink | W1 | W1 | W1 | W1 | W3 | W3 | W1 | W5 |
| Time period (second) from the application of the pretreatment liquid to the application of the white ink | 5 | 30 | 60 | 90 | 30 | 60 | 30 | 30 |
| Hiding performance | S | S | A | A | A | A | S | S |

TABLE 5

| | CEx 1 | CEx 2 | CEx 3 | CEx 4 | CEx 5 | CEx 6 | CEx 7 |
|---|---|---|---|---|---|---|---|
| Pretreatment liquid | UC1 | UC1 | UC1 | UC1 | UC1 | UC3 | UC1 |
| White ink | W1 | W2 | W2 | W2 | W4 | W1 | W6 |
| Time period (second) from the application of the pretreatment liquid to the application of the white ink | 120 | 5 | 30 | 60 | 60 | 60 | 60 |

TABLE 5-continued

| | CEx 1 | CEx 2 | CEx 3 | CEx 4 | CEx 5 | CEx 6 | CEx 7 |
|---|---|---|---|---|---|---|---|
| Hiding performance | B | B | B | B | B | B | B |

TABLE 6

| | Ex 1 | Ex 2 | Ex 3 | Ex 4 |
|---|---|---|---|---|
| Pretreatment liquid | UC1 | UC1 | UC1 | UC1 |
| White Ink | W1 | W1 | W1 | Wl |
| Color ink | C1 | C1 | C1 | C1 |
| Time period (second) from the application of the pretreatment liquid to the application of the white ink | 5 | 30 | 60 | 90 |
| Color development | S | S | A | A |

TABLE 7

| | CEx 1 | CEx 2 | CEx 3 | CEx 4 | CEx 5 | CEx 6 | CEx 7 |
|---|---|---|---|---|---|---|---|
| Pretreatment liquid | UC1 | UC1 | UC1 | UC1 | UC1 | UC3 | UC1 |
| White ink | W1 | W2 | W2 | W2 | W4 | W1 | W6 |
| Color ink | C1 | C1 | C1 | C1 | C1 | C1 | C1 |
| Time period (second) from the application of the pretreatment liquid to the application of white ink | 120 | 5 | 30 | 60 | 60 | 60 | 60 |
| Color development | B | B | B | B | B | B | B |

As shown in the above tables, the white printed textile item of each Example exhibited excellent results in the evaluation of the hiding performance. The color printed textile item of each Example showed excellent color development.

Further, in Example 1 to 4, in which the white ink W1 having a surface tension at 0.05 Hz of 36.7 mN/m was used, the result of the evaluation of the hiding performance further improved as the time period from the application of the pretreatment liquid to the application of the white ink became shorter.

On the other hand, in Comparative Example 1 in which the time period from the application of the pretreatment liquid to the application of the white ink was 120 seconds, the result of the evaluation of the hiding performance in the white printed textile item was poor, and the color development of the color printed textile item was also poor.

Comparative Examples 2, 3, and 4, in each of which a white ink having a high surface tension at 0.05 Hz was used, also showed poor results in the evaluation of the hiding performance in the white printed textile item, and also showed poor results in the evaluation of the color development of the color printed textile item. In Comparative Examples 2, 3, and 4, in the evaluation of the hiding performance in the white printed textile item, there was no difference in the results of the hiding performance depending on the time period from the application of the pretreatment liquid to the application of the white ink.

In Comparative Example 5 in which a white ink having a low surface tension at 0.05 Hz was used, Comparative Example 6 in which the specific gravity of the pretreatment liquid was lower than the specific gravity of the white ink, and Comparative Example 7 in which the surface tension of the white ink at 10 Hz was low, the results of the evaluation of the hiding performance in the white printed textile items were poor, and the color development of the color printed textile items was also poor.

It is to be noted that, besides those already mentioned above, many modifications and variations of the above embodiments may be made without departing from the novel and advantageous features of the present invention. Accordingly, all such modifications and variations are intended to be included within the scope of the appended claims.

What is claimed is:

1. A method for producing a printed textile item, the method comprising:

applying a pretreatment liquid containing a coagulant, water and a surfactant to a fabric, and after the application of the pretreatment liquid, applying a white ink containing a white pigment and water to the fabric by an inkjet method, wherein a surface tension of the white ink at 0.05 Hz is within a range from 33 to 39 mN/m, a surface tension of the white ink at 10 Hz is 40 mN/m or greater, a specific gravity of the pretreatment liquid is greater than a specific gravity of the white ink, and the application of the white ink is performed within 100 seconds from the application of the pretreatment liquid and by a wet-on-wet method.

2. The method for producing a printed textile item according to claim 1, wherein the surface tension of the white ink at 0.05 Hz is within a range from 35 to 38 mN/m, and the application of the white ink is performed within 1 to 50 seconds from the application of the pretreatment liquid.

3. The method for producing a printed textile item according to claim 1, further comprising applying a color ink by a wet-on-wet method after the application of the white ink.

4. The method for producing a printed textile item according to claim 1, wherein the coagulant contains at least one compound selected from the group consisting of metal salts, cationic polymers, and organic acids.

5. The method for producing a printed textile item according to claim 1, wherein the surface tension of the white ink at 0.05 Hz is within a range from 35 to 38 mN/m.

6. The method for producing a printed textile item according to claim 1, wherein the application of the white ink is performed within 1 to 50 seconds from the application of the pretreatment liquid.

7. The method for producing a printed textile item according to claim 1, wherein the coagulant contains a metal salt.

8. The method for producing a printed textile item according to claim 1, wherein the coagulant contains at least one compound selected from the group consisting of calcium chloride, calcium nitrate, and magnesium nitrate.

9. The method for producing a printed textile item according to claim 1, wherein the coagulant contains calcium nitrate.

10. The method for producing a printed textile item according to claim 1, wherein an amount of the coagulant, expressed as an active ingredient amount of the coagulant relative to a total mass of the pretreatment liquid, is 15% by mass or greater.

11. The method for producing a printed textile item according to claim 1, wherein the specific gravity of the pretreatment liquid is at least 0.040 greater than the specific gravity of the white ink.

12. The method for producing a printed textile item according to claim 1, wherein the specific gravity of the pretreatment liquid is 1.110 or greater.

13. The method for producing a printed textile item according to claim 1, wherein the specific gravity of the white ink is 1.100 or greater.

* * * * *